US007707780B2

(12) United States Patent
Ouellet et al.

(10) Patent No.: US 7,707,780 B2
(45) Date of Patent: May 4, 2010

(54) SYSTEM FOR ASSEMBLING A LOAD-BEARING SUPPORT STRUCTURE, AND STRUCTURE ASSEMBLED WITH SUCH A SYSTEM

(75) Inventors: Martin Ouellet, Boucherville (CA); Bertrand Potvin, Montréal (CA); Antoine Malette, Montréal (CA)

(73) Assignee: Scene Ethique Inc., Varennes (CA)

( * ) Notice: Subject to any disclaimer, the term of this patent is extended or adjusted under 35 U.S.C. 154(b) by 974 days.

(21) Appl. No.: 11/356,265

(22) Filed: Feb. 17, 2006

(65) Prior Publication Data

US 2006/0185258 A1 Aug. 24, 2006

Related U.S. Application Data

(60) Provisional application No. 60/653,985, filed on Feb. 18, 2005.

(30) Foreign Application Priority Data

Feb. 18, 2005 (CA) ..... 2497711

(51) Int. Cl.
*E04H 3/26* (2006.01)

(52) U.S. Cl. ..... 52/7; 52/263; 52/126.5

(58) Field of Classification Search ..... 52/6, 52/7, 263, 126.5, 126.6, 655.1, 843, 634
See application file for complete search history.

(56) References Cited

U.S. PATENT DOCUMENTS 4,090,340 A 5/1978 Becker
4,685,258 A 8/1987 Av-Zuk
4,843,792 A 7/1989 Rogers et al.
5,259,690 A 11/1993 Legge
5,848,501 A 12/1998 Taipale et al.
5,964,068 A 10/1999 O'Neill
6,006,680 A 12/1999 Quam et al.
6,106,186 A 8/2000 Taipale et al.
6,467,118 B2 10/2002 Dumlao et al.
6,581,339 B2 6/2003 Thiede
6,681,981 B2 1/2004 Paroly
6,922,947 B2 8/2005 Jines et al.
2001/0015045 A1 8/2001 Paroly
2004/0005430 A1 1/2004 Rogers
2004/0020154 A1 2/2004 Greschbach
2004/0123529 A1 7/2004 Wiese et al.
2005/0144857 A1 7/2005 Guerrero

*Primary Examiner*—Jeanette E Chapman
*Assistant Examiner*—Daniel Kenny
(74) *Attorney, Agent, or Firm*—Baker & Hostetler LLP

(57) ABSTRACT

A system for assembling a load-bearing support structure, and structure assembled with such a system. The system includes at least one supporting member, at least one connecting member, and at least one complementary member. Each supporting member includes an upper surface being provided with at least one section having at least one bulge protruding from the upper surface. Each connecting member is used for connecting a supporting member to at least one other member of the system. Each complementary member, typically a floor panel, is used for affixing onto a corresponding supporting member, and has at least one orifice being positioned, shaped and sized for inserting into a corresponding bulge of the corresponding supporting member so as form the load-bearing support structure. The system further includes at least one securing member cooperable between a given complementary member and a given supporting member for securing the complementary member onto the supporting member.

18 Claims, 5 Drawing Sheets

SIDE VIEW

NOTE: ALL DIMENSIONS INDICATED ON THIS DRAWING ARE SUBJECT TO CHANGE IN RELATION WITH LOAD CALCULATIONS

PLAN VIEW

ELEVATION VIEW

20
SEE DRAWING PTL-ASSY-2 FOR DETAILS
201
OPTION 2

204
202
203
201
OPTION 1

200
NOTE: ALL DIMENSIONS INDICATED ON THIS DRAWING ARE SUBJECT TO CHANGE IN RELATION WITH LOAD CALCULATIONS
200
10" [254mm]
7 17/32" [191mm]
SIDE VIEW 2 17/32" [64mm]
2 17/32" [64mm]
PLAN VIEW 200
10" [254mm]
7 17/32" [191mm]
ELEVATION VIEW

200

PLAN VIEW

ELEVATION VIEW

SYSTEM FOR ASSEMBLING A LOAD-BEARING SUPPORT STRUCTURE, AND STRUCTURE ASSEMBLED WITH SUCH A SYSTEM

CROSS-REFERENCE TO RELATED APPLICATIONS

The present application claims priority of U.S. provisional application No. 60/653,985 and CA patent application No. 2,497,711, both filed Feb. 18, 2005, the contents of which are incorporated herein by reference.

FIELD OF THE INVENTION

The present invention relates to a system for assembling a load-bearing support structure. More particularly, in its preferred intended use, the present invention relates to a system for assembling a mountable and demountable load-bearing support structure, the system being used for mounting, whether provisionally or permanently, corresponding structures, such as stages and the like, which are typically used for entertainment purposes and/or special events. The present invention also relates a support structure having been assembled with the system, and to a method of assembling associated thereto.

BACKGROUND OF THE INVENTION

Systems for assembling support structures and the like are well known in the art. Known to the Applicant are the following U.S. patent and patent applications: U.S. Pat. No. 4,090,340; 4,685,258; 4,843,792; 5,259,690; 5,848,501; 5,964,068; 6,006,680; 6,106,186; 6,467,118 B2; 6,581,339 B2; 6,681,981 B2; 6,922,947 B2; 2001/0015045 A1; 2004/0005430 A1; 2004/0020154 A1; 2004/0123529 A1; and 2005/0144857 A1.

It is also well known in the art that, from the moment stage designers wished to use scenic space differently than in a traditional theatre, problems with temporary or semi-permanent load-bearing structures appeared. The properties required to answer their needs evolved in such a manner that they became contradictory: a) "lightness for transportation", manual handling and visual aspect; b) "sturdiness" for load-bearing capacity, for the capability of integrating other scenic elements and for security concerns; c) optimization of the "minimal number of components" and hardware to facilitate the transfer of the special events from city to city while reducing the set up time; and d) a "better use of space" for equipment storage or the planning of the working space for technicians underneath the structures.

It is also well known that no integrated system existed to completely satisfy these multiple needs emanating from the stage designer's innovative concepts. This is why load-bearing structures destined for entertainment purposes and/or special business events, and the like, to this day, come from the combination of various components designed for other usages.

Indeed, the first modern temporary stages were laid out on flat bed semi-trailers onto which one built a temporary proscenium structure made of plywood and wooden beams on site. The limitations of this installation method were rapidly reached mainly due to the limited performance area of the stage space, the complexity and difficulty to render the installation secure, the impossibility to anchor the complex scenic elements, and the costly and long set up time. Moving the "stage" was done by pinning a tractor to the front of the trailer as with standard trucks. Understandably, this limited this arrangement to exterior events or to theatres and/or amphitheatres able to accommodate a tractor-trailer combination.

Modular scaffolding typically used in the construction business was another option. This system could be used indoors or outdoors, permits a larger performance area and also made adding supplemental technical spaces easier (stage manager's booth, sound and lighting control booths, etc.).

The following description of the main components of this system as used in the scenic domain, namely, a) the section of structure secured with cross-bracing and guy wiring; b) the beam system for the installation of floor and floor panels; and c) the planning of ramps and special configurations; will highlight the inconveniences and limitations of each aspect of such a conventional system.

In regards to the section of structure secured with cross-bracing and guy wiring, the reinforcement of scaffolding sections with cross-braces and guy wires allows a certain point load and dynamic load capacity. However, in a scenic use, the limit of these loads is quickly reached. Indeed, by adding dynamic elements like a stage elevator or a mechanized trap, the scaffolding structure is solicited in upward motion and in torsion, forces for which it is not designed. Therefore, to permit their integration to the scaffold stage base, it is necessary that the scenic elements have their own structure. The task thus becomes complex since standard scaffolding components limit the possible configurations.

From a more practical point of view, the set of legs and cross-braces located under and in the scaffold structure prevents the optimization of the "so-called" utilitarian space under the floor for technical planning, storage or dressing rooms.

In regards to the beam system for the installation of floor and floor panels, to be maintained in place, the beams must be previously attached onto sections of scaffolding. Next, sheets of plywood to make-up the floor must be fixed onto the beams. This process of assembly quickly becomes cumbersome in time and in manpower. To ensure the required structural capacities, the multiplication of beams becomes necessary as, for example, with the "Alumabeam™" type system. This hydride beam results from the combination of an "I" shape aluminium piece that embeds a piece of wood allowing the screwing down of the plywood sheets.

Floor panels are in fact plywood sheets superimposed in two (2) staggered layers. Plywood has a limited point of load bearing, a restricted dynamic load bearing and a weak resilience capacity. To fulfill its role efficiently, the plywood must necessarily be installed with a set of beams to constitute the floor or to permit the integration of a scenic element. In that case, the removal of plywood sheets (for traps, elevators etc.) is often required and inevitably implies the addition of vertical and lateral supports after having made the required analysis of the necessary load distribution.

There exists another type of floor panel among the standard scaffoldings components: the aluminium structure with inset plywood deck. These are laid out side-by-side along the width of the scaffolding sections rendering the screwing down of additional plywood sheets possible.

Among the inconveniences of using plywood sheets in fabricating the floor are the rapid wear of the plywood sheets due to the constant screwing and unscrewing, the need for repeated application of paint on the surface, breakage due to handling and transport, loss of material due to cuts for adjusting finished contours of the installation, the multiplication of costs due to the doubling of plywood sheets as well as the overall handling. Here, the term "handling" is used to designate the work team and the rental of machinery for the loading, installation and dismantling of the scaffolding's structural components.

In regards to the planning of ramps and special configurations, with the system of modular scaffolding, the integration of ramps and levels for lowered or raised floors is complex. Indeed, the structural components used are governed by layouts in pre-established widths and lengths and do not offer the required flexibility.

It is also well known in the art that the principle of a stage using hydraulic deployment, such as Stageline™, is another type of installation. It is made-up of one (1) 45'- or 53'-long trailer of which the two (2) sides fold down using hydraulic actuators to form a floor. The roofs of the trailers are on hydraulic cylinders, and once raised to the correct height, they spread out in width in order to become the roof over the stage. It is an effective system offering several advantages such as its set-up time, the protection that it offers against the weather, and good structural capacities. This stage can be used both outdoors and indoors (in the big amphitheatres). On the other hand, some inconveniences exist, namely: a) confined stage area because enlarging the stage, if required, must necessarily be done by adding scaffolding or another type of temporary structure; b) specialized man-power is required; c) high rental costs; d) impossibility of integrating dynamic stage equipment (turntables, elevators, traps, etc.); and e) this type of stage only offers a unique layout.

It is also known in the art that the Wenger™ stage is another type of temporary structure. Intended for interior use, it consists of platforms with removable telescoping legs. The surface of this platform is made of MDF, encased in a galvanized steel or aluminum frame. The installation is relatively simple: butting together platforms whose legs are extended and using stirrups, positioned under the platforms, to join them together. To facilitate the adjustment of platforms one to the other, some fabricators integrate fastenings elements such as the Rotoloc™ under the MDF sheets. This is a two-part attachment device, operated from above the panel with an hexagonal key, that permits the lateral locking of one part to the other.

The main inconveniences of this type of stage are several, namely: a) the assembly area must be relatively level; b) the joining system between platforms is under the platforms and difficult of access; c) it is impossible to screw directly into the floor surface of this platform; d) to conceal the metal edges of the assembled platforms, double-sided tape is laid along the edges allowing the laying of one or two (2) thicknesses of plywood on top of the platforms—the procedure meets three (3) objectives: to give a regular surface to the assembly, to allow for a screwing surface for the setting up of scenery, and finally, for aesthetic requirements; e) the assembled platforms do not permit an equal spread of loads between them; f) the Rotoloc™ system used between the platforms has no structural value since in does not allow for torsion nor for load-bearing; g) the anchoring and/or integration of dynamic elements, either mechanized or not, is not possible unless one modifies the platform permanently; h) at the time of the application of a dynamic load, a whole series of measures are required to maintain the structural properties of the platforms—these include re-enforcing and stabilising the platform assembly; and i) the assembly of a large area using this platform type with a height lower than about 30 cm becomes difficult since the adjustment of the stirrups takes place under the platforms—additionally, the available heights of the telescopic legs are limited.

It is also known in the art that the folding wooden parallel platform is a rudimentary and temporary structure, traditionally used for opera and theatre for certain limited applications. For installation, the wooden structures are unfolded and then joined together by screwing them one to the other. Next, plywood sheets are laid on the structures and screwed in place. The doubling of plywood sheets is generally required to prevent the deflection of the floor in its center, to increase the structural capacity of the surface and to give a uniform floor surface finish.

This folding wooden parallel platform presents the following inconveniences, namely: a) the friability of the material used to build these platforms limits the life expectancy and the reliability in a frequent set up and tear down context and its resistance to the elements (exterior use); b) the assembly of a large area is labour intensive; c) the plywood floor panels are not bonded to the overall structure but only to the individual platform; d) the anchoring of the scenic elements becomes hazardous; e) costly set-up and adjustment times; f) height is limited; g) the levelling of the structure is complex; and h) the admissible static and dynamic loads are limited. At the most, this type of platform is still used for raising a scenic component or a musical set-up on stage in the case of indoor theatre or a covered outdoor stage.

Hence, in light of the aforementioned, there is a need for an improved system which would be able to overcome some of the aforementioned prior art problems.

SUMMARY OF THE INVENTION

An object of the present invention is to provide a system which, by virtue of its design and components, satisfies some of the above-mentioned needs and which is thus an improvement over other related systems and/or methods known in the prior art.

In accordance with the present invention, the above object is achieved with a system for assembling a load-bearing support structure, the system comprising:

at least one supporting member, said at least one supporting member comprising an upper surface, and opposite first and second end surfaces, the upper surface being provided with at least one section comprising at least one bulge protruding from said upper surface;

at least one connecting member for connecting said at least one supporting member to at least one other member;

at least one complementary member for affixing onto at least one of said at least one supporting member, said at least one complementary member comprising at least one orifice being positioned, shaped and sized for inserting into the at least one bulge of a corresponding supporting member so as form the load-bearing support structure.

Preferably, the system also comprises at least one securing member cooperable between the at least one complementary member and the at least one supporting member for securing said at least one complementary member onto said at least one supporting member.

According to another aspect of the present invention, there is also provided a load-bearing support structure assembled with the above-mentioned system.

According to another aspect of the present invention, there is also provided a method of assembling a system such as the one briefly described herein and such as the one exemplified in the accompanying drawings.

According to another aspect of the present invention, there is also provided a method of mounting the above-mentioned structure.

According to yet another aspect of the present invention, there is also provided a method of manufacturing and/or assembling the various components of the above-mentioned system and/or structure.

As aforementioned, and as will be explained in greater detail hereinbelow, the system according to the present invention preferably comprises three (3) main different types of components, namely at least one supporting member (hereinafter referred to also as "open shell truss" or simply "OST"), at least one connecting member (hereinafter referred to also as a "quad bowtie connector" or simply "QBC"), and at least one complementary member (such as a floor panel, for example, and the like). Preferably also, the present invention further includes at least one securing member (hereinafter referred to also as a "push, turn and lock" system or simply "PTL"), which preferably includes male and female components, as will also be explained in greater detail hereinbelow. The above-mentioned components of the system and others thereof may be provided in a plurality of numbers and interconnected to each other via different corresponding configurations so as to mount a variety of assorted load-bearing support structures.

The objects, advantages, and other features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

Figure 1:
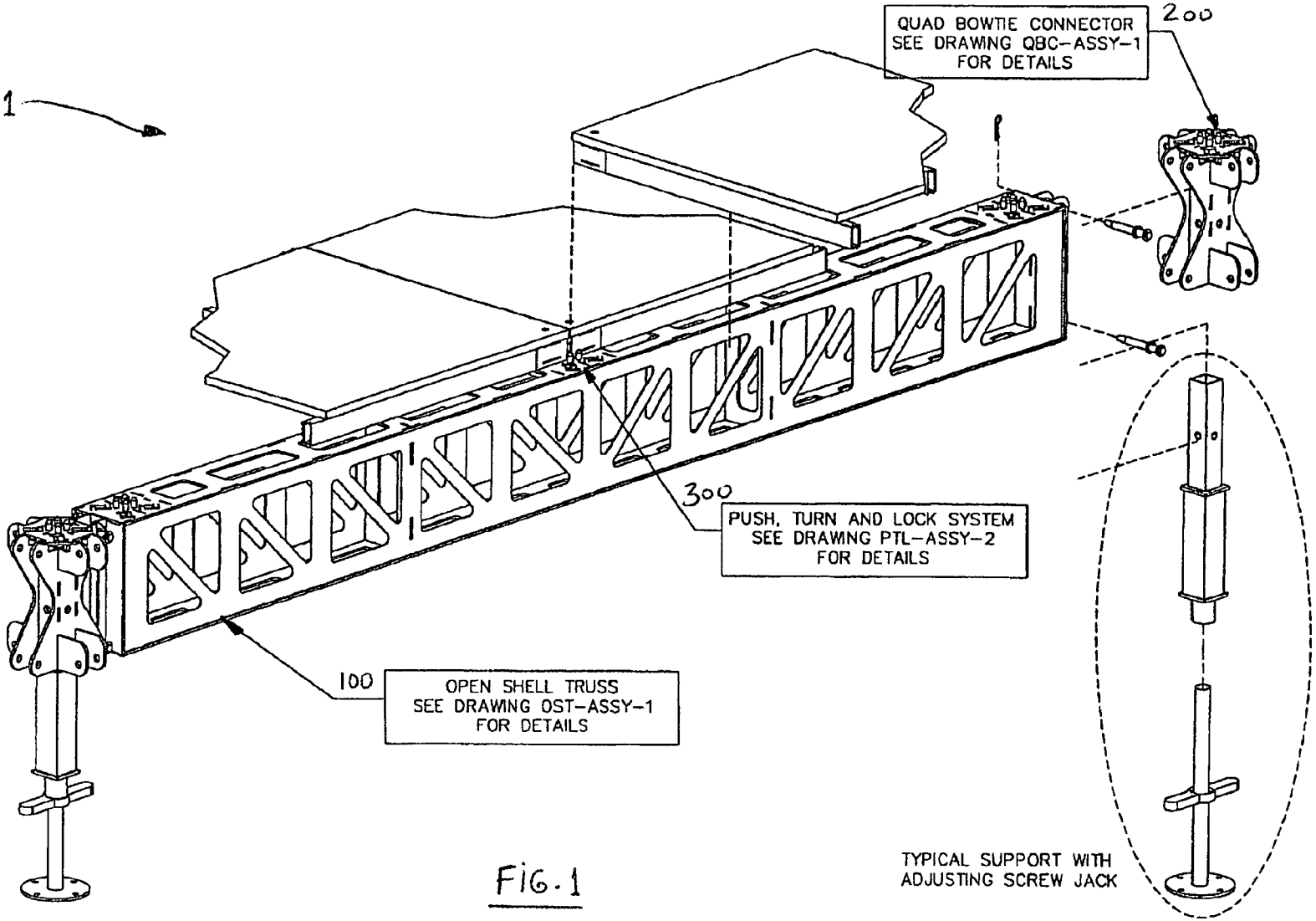
FIG. 1 is a partial exploded view of a load-bearing support structure to be mounted with a system according to a first preferred embodiment of the present invention.

In the following description, the same numerical references refer to similar elements. The embodiments, dimensions and/or loads shown in the figures and/or mentioned herein are preferred, given for exemplification purposes only.

Moreover, although the present invention was primarily designed for mounting stages and the like, it may be used for mounting other types of objects and/or other types of load-bearing or supporting structures, as apparent to a person skilled in the art. For this reason, expressions such as "stage", "entertainment", "installation", "support", "structure", etc., used herein should not be taken as to limit the scope of the present invention and includes all other kinds of objects and/or applications with which the present invention could be used and may be useful.

Moreover, in the context of the present invention, the expressions "device", "system" and "kit", as well as any other equivalent expressions and/or compound words thereof, may be used interchangeably. The same applies for any other mutually equivalent expressions, such as "support", "stage", "installation", and "structure" for example, as well as "panel", and "floor", as well as "component" and "member", as well as "first" and "vertical", and also "assembling", "mounting" and "forming", and/or any derivatives thereof, which will also be used interchangeably in the context of the present invention, as also apparent to a person skilled in the art.

In addition, although the preferred embodiments of the present invention as illustrated in the accompanying drawings comprises various components, and although the preferred embodiments of the system and corresponding components as shown consist of certain geometrical configurations and orientations as explained and illustrated herein, not all of these components, geometries and orientations are essential to the invention and thus should not be taken in their restrictive sense, i.e. should not be taken so as to limit the scope of the present invention. It is to be understood, as also apparent to a person skilled in the art, that other suitable components and cooperations thereinbetween, as well as other suitable geometrical configurations and orientations may be used for the system and corresponding components/members according to the present invention, as will be briefly explained herein and as can be easily inferred herefrom, without departing from the scope of the present invention, as can also be easily understood by a person skilled in the art.

Broadly described, the system according to the present invention, is a system for assembling a support structure, such as stages and the like, for example, and/or any other type of supporting structure, preferably in a mountable and demountable manner, as will be easily understood from the present description by a person skilled in the art. Indeed, the system according to the present invention is a system of structural components/members for temporary or permanent mounting of fixed installations or touring installations that preferably includes three (3) main different types of components, namely at least one supporting member (hereinafter referred to also as "open shell truss" or simply "OST"), at least one connecting member (hereinafter referred to also as a "quad bowtie connector" or simply "QBC"), and at least one complementary member (such as a floor panel, and the like), as well as a preferred fourth component, namely at least one securing member (hereinafter referred to also as a "push, turn and lock" system or simply "PTL"), which preferably includes male and female components, as will also be explained in greater detail hereinbelow, each of the above-mentioned components being provided in suitable numbers and interconnected to one another, as will also be explained in greater detail hereinbelow, in order to be able to mount different varieties and assortments of load-bearing support structures.

According to the preferred intended use, these structures preferably consist of stages as used in the entertainment world and/or for special events, such as conferences and the like, and the structures may consist of temporary mounted or permanently fixed installations or touring applications.

LIST OF NUMERICAL REFERENCES AND CORRESPONDING PREFERRED COMPONENTS ILLUSTRATED

1. system
100. supporting member (open shell truss ("OST"))
101. surface of the supporting member (e.g. laser cut steel plate)
102. connecting flange of the supporting member
200. connecting member (quad bowtie connector ("QBC"))
201. connecting flange of the connecting member (e.g. laser cut steel plate)
202. locking point for the truss support
203. slit
204. channel
300. securing member (push, turn and lock ("PTL") system)
300*a*. male component (of the "PTL")
301*a*. pressure bolt
302*a*. washer
303*a*. spring
304*a*. casing
305*a*. guiding sleeve
306*a*. locking cross tee
307*a*. recess of the casing
300*b*. female component (of the "PTL")
301*b*. optional pate of the QBC (e.g. laser cut steel plate)
302*b*. bulge
303*b*. slots
304*b*. folded cut out (e.g. thrust)
305*b*. slit
306*b*. orientation cut out According to the present invention, and as exemplified in the accompanying drawings, namely FIG. 1, the system for assembling a load-bearing support structure comprises at least one supporting member, at least one connecting member, and at least one complementary member (typically, a floor panel and/or the like, although other structural or decorative members could be used with the present invention). Each supporting member, as better exemplified in FIGS. 1-5, preferably comprises an upper surface, and opposite first and second end surfaces, the upper surface being provided with at least one section comprising at least one bulge protruding from said upper surface. Each connecting member, as better exemplified in FIGS. 1 and 6-10, is preferably used for connecting at least one supporting member to at least one other member (whether a supporting member, another connecting member, yet another component of the system and/or another component separate from the system, such a fixed wall, for example). Each complementary member (such as a floor panel, for example, as better shown in FIG. 1) is preferably used for affixing onto at least one of the supporting members, and preferably comprises at least one "orifice" (whether hole, cavity, recess, receptacle, and the like) being positioned, shaped and sized for inserting into a corresponding bulge of a corresponding supporting member, as better shown in FIG. 1, so as form the load-bearing support structure.

Preferably, each concerned section of the upper surface of a supporting member comprises at least two bulges, each bulge being used for receiving a corresponding complementary member of the system. Preferably also, and advantageously, each concerned section of the supporting member comprises four of such bulges, so that a given section can preferably receive four corresponding complementary members (e.g. separate corners of four different floor panels) of the system, as can be easily understood when referring to FIG. 1.

Figure 2:
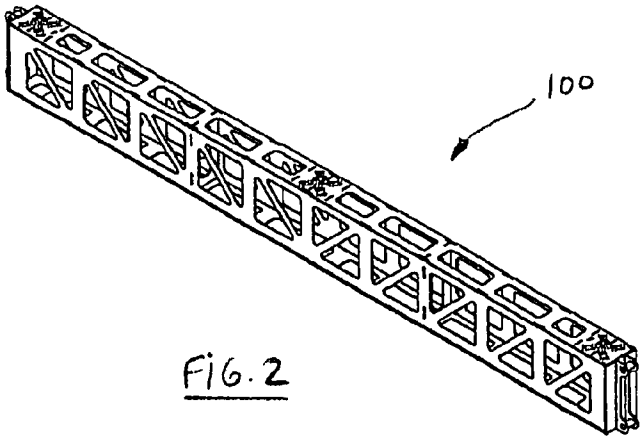
FIG. 2 is a perspective view of the supporting member ("open shell truss") shown in FIG. 1.
Figure 5:
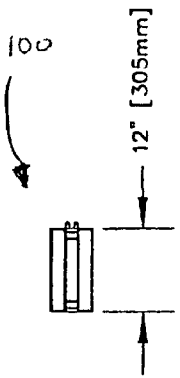
FIG. 5 is a side view of what is shown in FIG. 3.
Figure 4:
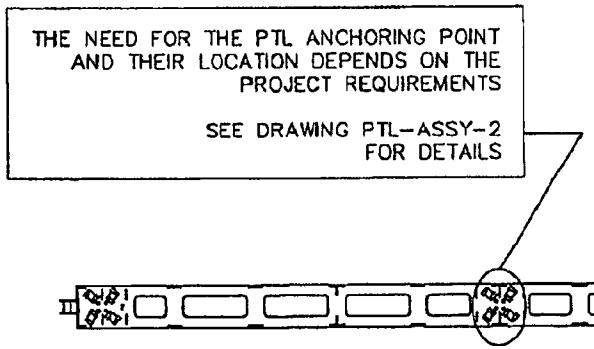
FIG. 4 is a top view of what is shown in FIG. 3.
Figure 3:
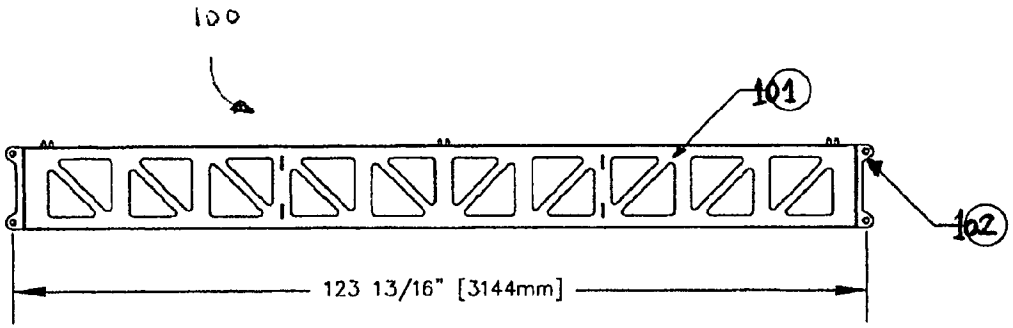
FIG. 3 is a side elevational view of what is shown in FIG. 2.

Preferably also, the four bulges are positioned about the upper surface of the at least one supporting member so as to form a rectangular configuration, but according to the preferred embodiment of the present invention, the four bulges are positioned about the upper surface of the supporting member so as to form a square configuration, as better shown in FIGS. 2 and 4.

Preferably also, the upper surface of the supporting member comprises first and second of the aforementioned sections, said two sections being positioned respectively on opposite end sections of the upper surface of the at least one suppporting member, as well as, preferably, a third section comprising at least one bulge (preferably, at least two bulges, and according to the preferred embodiment of the invention, four of such bulges, as above-discussed). This third section is preferably positioned between the first and section sections, substantially at a midpoint section of the upper surface of the supporting member, as better shown in FIGS. 1-5, but it is to be understood that according to the present invention, more that one of such mid-sections could be provided on the upper surface of the supporting member, and that these mid-sections would be preferably positioned equidistantly from one another, between the first and second opposite end sections.

Each end surface of each supporting member is preferably provided with a least one connecting flange, each connecting flange being connectable with a corresponding connecting flange of the at least one connecting member, typically by means of a corresponding connecting device, such as a pin, bolt, and/or the like. Preferably, each end surface of the supporting member comprises upper and lower connecting flanges, said upper and lower connecting flanges being connectable to corresponding upper and lower connecting flanges of a corresponding connecting member. According to the preferred embodiment of the present invention, each end surface of the supporting member comprises a pair of upper and lower connecting flanges, said pair of upper and lower connecting flanges being connectable to a corresponding pair of upper and lower connecting flanges of a corresponding connecting member, and/or other member.

As better exemplified in FIGS. 1-5, each supporting member preferably comprises a lower surface, opposite to the upper surface thereof, and further comprises opposite front and rear surfaces. Preferably also, each supporting member has a substantially hollow and substantially rectangular cross-section. Preferably also, at least one surface of each supporting member, preferably the upper, lower, front and rear surfaces thereof, is provided with perforated areas. According to the preferred embodiment of the present invention, each supporting member is an open shell truss, referred to also herein as "OST", as previously mentioned.

FIG. 1 shows a partial perspective view of a load-bearing support structure to be mounted according to a preferred embodiment of the present invention, the different components thereof being shown in an exploded relationship. As shown, the system according to the present invention may also preferably comprise corresponding structure supports or legs, with adjusting srew jacks and the like, for example, which could also be replaced by any other suitable stable supports known in the business, as apparent to a person skilled in the art, so as to provide for a suitable clearance underneath the load-bearing structure assembled with the system according to the present invention.

Referring again to FIGS. 1-5, there is shown different views of an open shell truss ("OST") according to a preferred embodiment of the present invention. As shown, the OST preferably comprises laser cut steel plates (i.e. "surfaces"), as well as corresponding pins and sleeve connecting flanges, as aforementioned.

The laser cut steel plates are preferably plates designed to optimize their strength and limit their weight. Preferably also, rectangular slits selectively provided on the plates permit a precise assembly of the preferred four plates that make up the peripheral cross-sectional area of the truss. Once assembled, these slits can also serve as locations for plug welds. Since, according to its preferred embodiment, it is of substantially hollow design, the galvanization of the whole truss is possible and allows for exterior use of the structure. It is worth mentioning also that several modifications could be made to these particular components and features of the open shell truss. Namely, the material used for this assembly of plates can be any other suitable structural material that offers sturdiness and load-bearing capability, as apparent to a person skilled in the art. Furthermore, the dimensions, height, width and thickness of the plates can also be adapted to the load requirements of the particular application for which the open shell truss is intended for, as also apparent to a person skilled in the art.

The pin and sleeve connecting plates of the open shell truss are preferably double-steel plates at each end of the truss with two connecting points to join the truss to a quad bowtie connector, as will be explained hereinbelow. The vertical distance between the connecting points offers the stability required to avoid bracing the legs that are supporting the structure. This is true within a reasonable height of installation, as apparent to a person skilled in the art. The joining of the truss to its connection can be done in a variety of suitable manners, but according to the present invention, is preferably done by either pins, or in case of permanent installation, by bolts, as aforementioned.

It is worth mentioning however that the connecting points for the truss can be any suitable corresponding support offering the proper structural capacity, and that the truss can be installed at an angle (vertical or other), if required, since the connecting points (upper and lower connecting flanges) are preferably designed to support by themselves the total load at the end of the truss, as can be easily understood by a person skilled in the art.

Moreover, the truss could be used with or without the securing member (push, turn and lock system) of the present invention to anchor a complementary member (e.g. floor structure). Indeed, instead of securing members, scenographic layouts could require another mechanical anchoring which is possible to adapt to the truss considering its design, as can also be easily understood by a person skilled in the art.

Referring now to FIGS. 6-10, there is shown a connecting member according to preferred embodiments of the present invention. Indeed, each connecting member preferably has opposite first and second end surfaces, and opposite front and rear end surfaces (i.e. four sides), the first and second end surfaces of the connecting member being each provided with a least one connecting flange, each conecting flange being connectable with a corresponding connecting flange of the at least one supporting member, as better shown in FIG. 1.

Each end surface of the connecting member, whether first, second, front and/or rear, is preferably provided with upper and lower connecting flanges, said upper and lower connecting flanges being connectable to corresponding upper and lower connecting flanges of at least one other member (whether a supporting member, another connecting member, yet another component of the system and/or another component separate from the system, such a fixed wall, for example). According to the preferred embodiment of the present invention, each end surface of the connecting member, whether first, second, front and/or rear, is provided with a pair of such upper and lower connecting flanges, as better shown in FIGS. 6-10.

Preferably also, each connecting flange of the system comprises a hole so that a corresponding connecting flange of a connecting member, or other member, may be removably connectable onto a corresponding connecting flange of a supporting member, or other member, by means of a corresponding pin, bolt, or other, insertable into said two corresponding holes.

Figures 6, 7, 8, 9, 10:
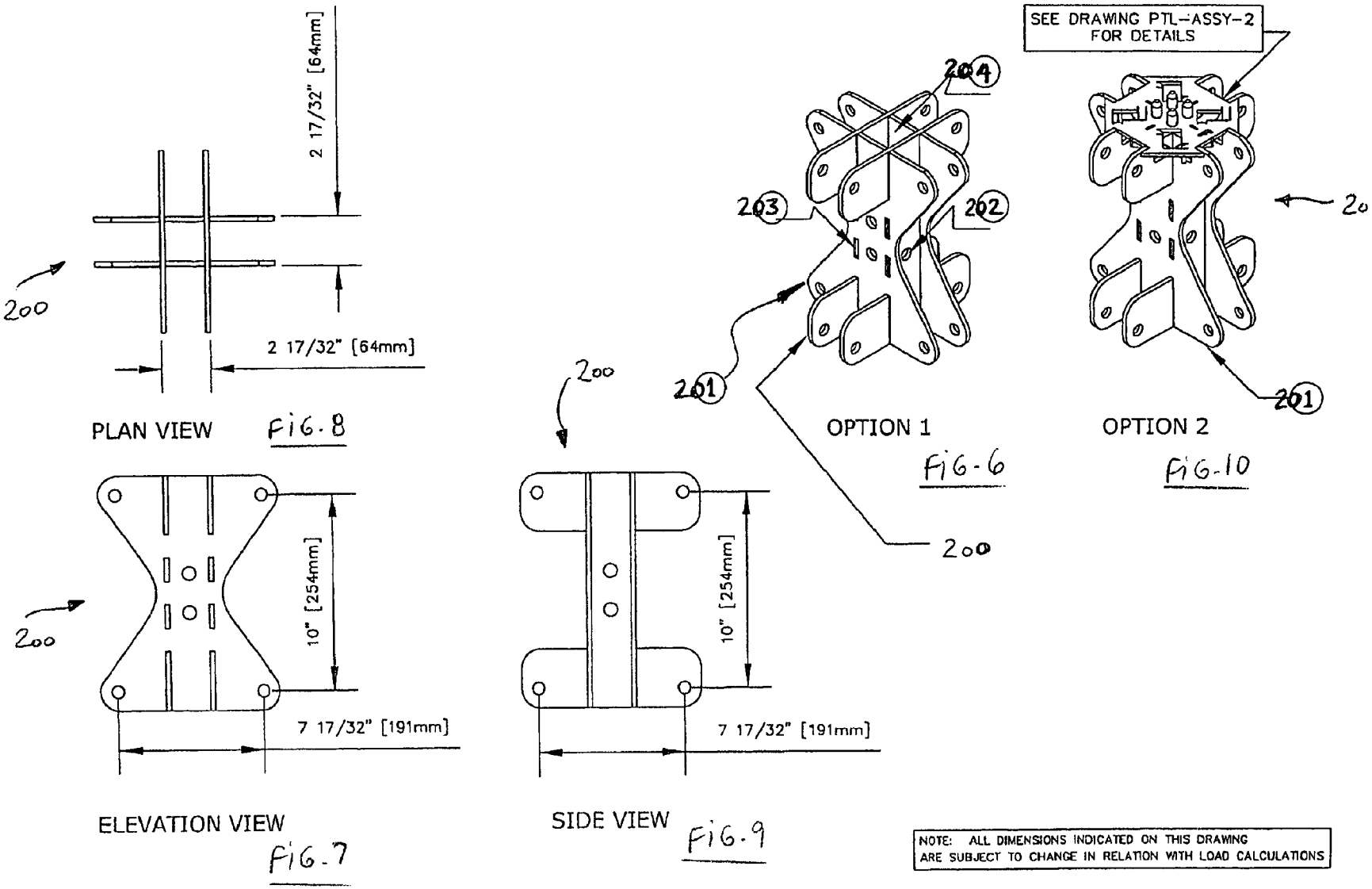
FIG. 6 is a perspective view of a connecting member ("quad bowtie connector") according to a first preferred embodiment of the present invention.
FIG. 7 is a side elevational view of what is shown in FIG. 6.
FIG. 8 is a top view of what is shown in FIG. 7.
FIG. 9 is a side view of what is shown in FIG. 7.
FIG. 10 is a perspective view of a connecting member ("quad bowtie connector") according to yet another preferred embodiment of the present invention.

Preferably also, and as better shown in FIGS. 6 and 8, each supporting member comprises a channel defined within said at least one supporting member and extending from a lower surface to an upper surface thereto, the channel being preferably configured for receiving therein an additional component of the system, such a support leg with an adjusting screw jack, for example, as aforementioned and as exemplified in FIG. 1.

Alternatively, and for some other particular applications of the present system and/or desired end results, the upper surface of the connecting member could be provided with a plate comprising at least one bulge (preferably two bulges, and even more preferably, four bulges) protruding from said upper surface for receiving a corresponding orifice of a corresponding complementary member (e.g. floor panel) of the system, as above-discussed. Preferably also, the plate comprises a slot adjacent to each bulge of the plate for receiving a corresponding component of a corresponding member (e.g. a securing member) of the system, as will be explained in greater detail hereinbelow when referring to FIGS. 11-20.

Referring back to FIGS. 6-10, illustrating different views of the quad bowtie connector ("QBC") according to preferred embodiments of the present invention, it can be easily understood that this component may be used on its top part as a floor panel anchoring point or a receptacle for stacking structures.

As illustrated, the QBC preferably comprises laser cut steel plates (i.e. "connecting flanges" and supports thereof defining the inner channel of the connecting member) which are preferably steel plates embedded together to form a quadruple connecting point (four connecting faces or sides) for the open shell truss or other components to be used with the system according to the present invention. Each side can preferably receive one end of a truss. Each connecting point on one side of a QBC (top and bottom) is preferably designed to support alone the load imposed by a truss and its different floor panels.

It is worth mentioning that several modifications could also be made to the above-described component, namely on corners of the scene layout, for example. Indeed, the connecting points not used for the truss support could allow for guardrails, facings, or scenographic elements to be hung or anchored thereon, as aforementioned when referring to other components which could be used with the present invention, as apparent to a person skilled in the art.

The QBC also comprises locking points for the truss support, and these holes with the proper tolerance are preferably designed to secure the legs or supports that keep the truss leveled, as can be easily understood when referring to FIG. 1. Pins or bolts can be used depending on the structural requirements. If the top part of the QBC is used for the anchoring of the floor panels, then only one hole is necessary, as apparent to a person skilled in the art. It is worth mentioning however that the number of locking points on each QBC can be greater if the design of the scenographic structure requires it, as also apparent to a person skilled in the art.

As also better illustrated in FIGS. 6-10, the QBC preferably comprises rectangular slits. As on the truss, these preferred rectangular slits in the plates allow for a precise assembly of the preferred four plates that make up the truss. Once assembled, the slits also serve as plug welds locations.

It is to be understood also that the quad bowtie connector can allow, on its top part, a securing member (i.e. female part of the PTL) for the floor structure, as better illustrated in FIG. 10 (option2), or an opening where one could insert another support (a leg, for example) to create another structure on top, as aforementioned and as can be easily understood when referring to FIG. 6 (option 1). As previously explained, the number of locking points is then increased, as apparent to a person skilled in the art.

According to a preferred and advantageous embodiment of the present invention, the system further comprises at least one securing member, as better exemplified in FIGS. 11-20, cooperable between the at least one complementary member and the at least one supporting member for securing said at least one complementary member onto said at least one supporting member, as can be easily understood when referring to FIG. 1, in which case, the supporting member, shown in FIGS. 1-5, and/or the optional plate of the QBC shown in FIG. 10, preferably comprises corresponding slots, as aforementioned, the intended use of which will be explained in greater detail hereinbelow.

Figures 11, 12, 13, 14, 15:
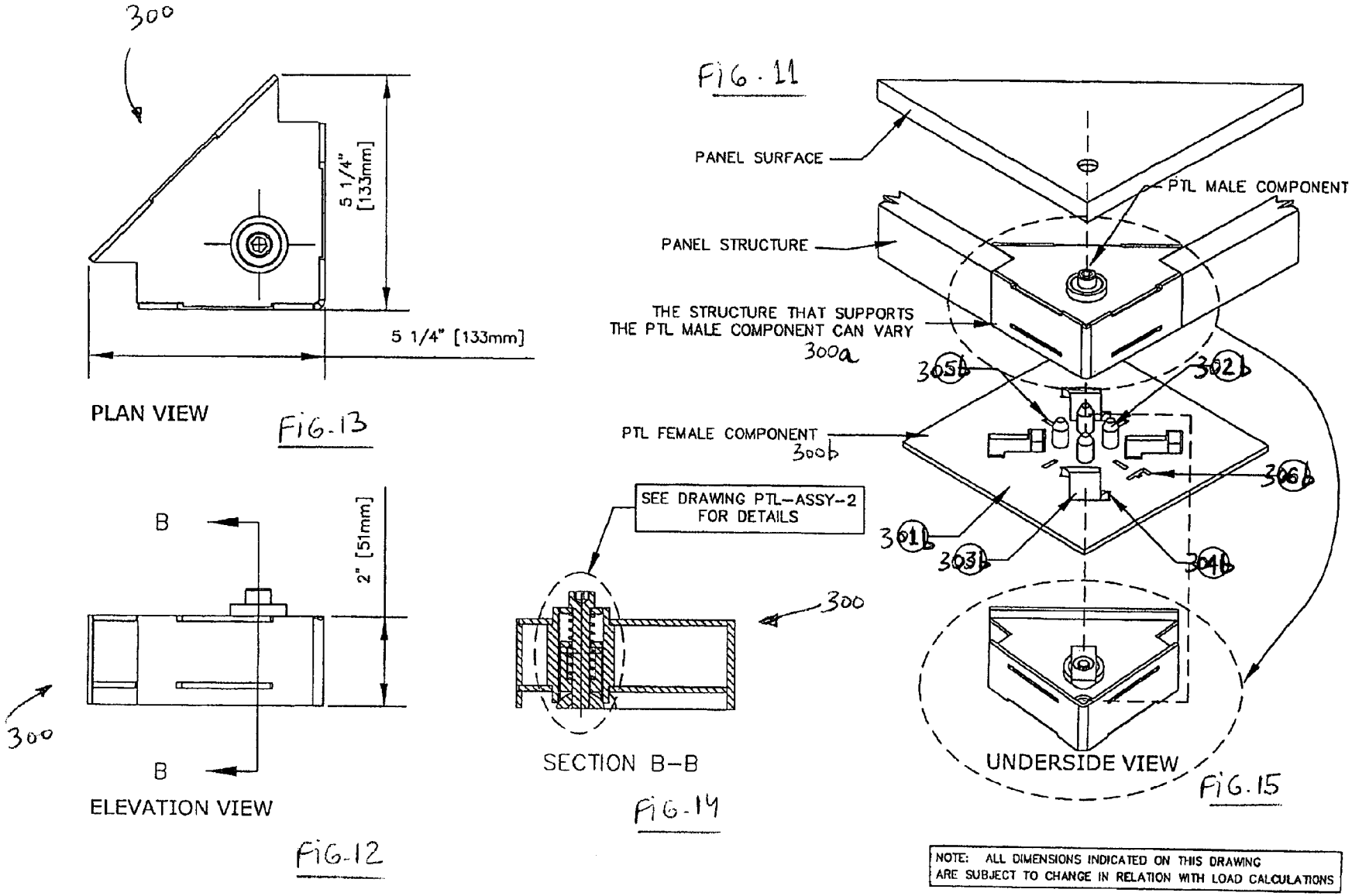
FIG. 11 is a partial exploded view of a securing member ("push, turn and lock" system), including male and female components thereof, cooperating with a complementary member (e.g. panel surface) according to a preferred embodiment of the present invention.
FIG. 12 is a side elevational view of the securing member ("push, turn and lock" system) shown in FIG. 11, said securing member ("push, turn and lock" system) being shown in an assembled configuration.
FIG. 13 is a top view of what is shown in FIG. 12.
FIG. 14 is a sectional view taken along line B-B of what is shown in FIG. 12.
FIG. 15 is an underside view of the male component of the securing member ("push, turn and lock" system) shown in FIG. 11.
Figure 20:
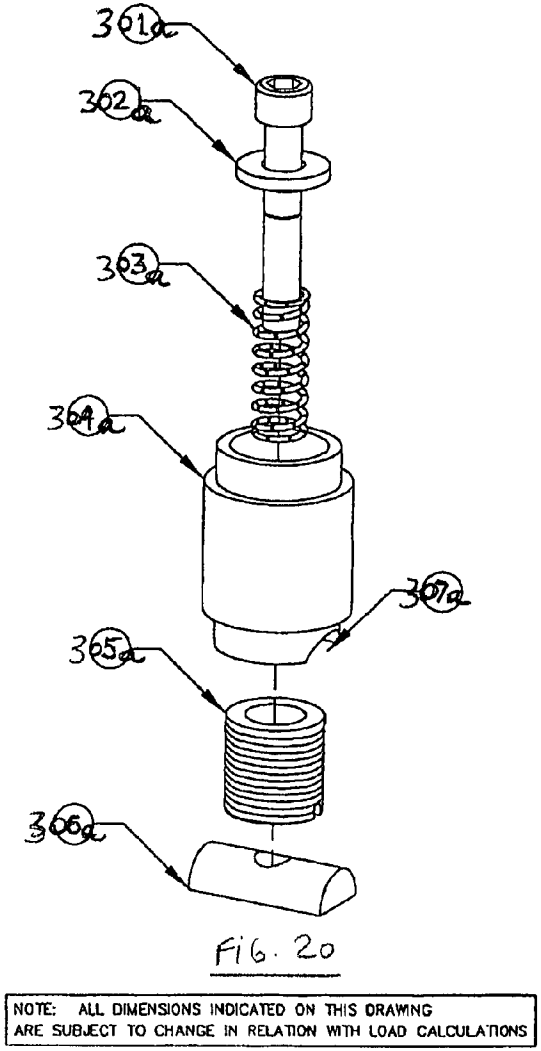
FIG. 20 is an exploded view of what is shown in FIG. 16.
Figure 16:
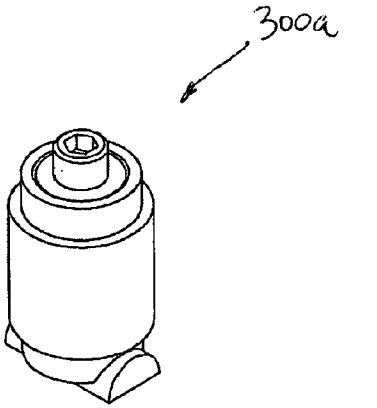
FIG. 16 is a perspective view of a male component of the securing member ("push, turn and lock" system) according to a preferred embodiment of the present invention.
Figure 19:
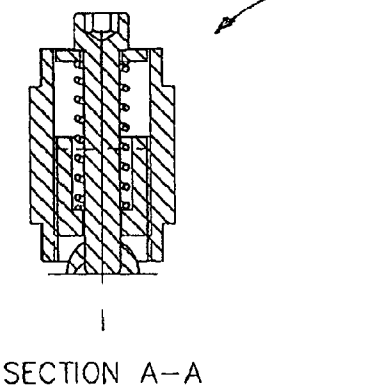
FIG. 19 is a sectional view taken along line A-A of what is shown in FIG. 17.
Figure 18:
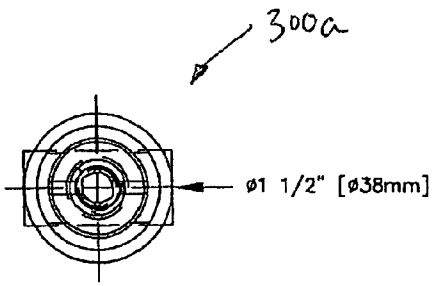
FIG. 18 is a top plan view of what is shown in FIG. 17.
Figure 17:
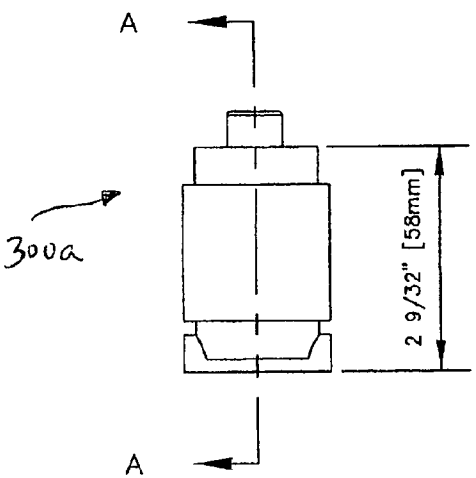
FIG. 17 is a side elevational view of what is shown in FIG. 16.

Indeed, referring to FIGS. 11-20, each securing member preferably comprises a casing having opposite upper and lower ends, and a fastener extending within the casing and being displaceable- thereabout, that is, and preferably, in a direction substantially parallel to that of the longitudinal axis of the casing, as can be easily understood from FIGS. 14, 19 and 20. The fastener is preferably insertable through a corresponding slot of the at least one supporting member (and/or optional plate of the QBC, as can be easily understood from FIG. 11), and has a first extremity provided with a head as well as an opposite second extremity extendable beyond the lower end of the casing for receiving a locking tee positionable via the fastener beyond the corresponding slot of the at least one supporting member (and/or optional plate of the QBC when referring to FIG. 11), the locking tee being cooperable with said fastener and said corresponding slot so that a rotation of the fastener via its head (provided preferably with a socket for receiving a corresponding key) operatively urges the locking tee towards the head of the fastener, as can be easily understood from FIGS. 14 and 19, and in abutment relationship with an underside portion of the corresponding slot, so as to operatively clamp the at least one supporting member (and/or optional plate when using a QBC such as the one illustrated in FIG. 11) between the casing and the locking tee of the at least one securing member.

Preferably, and as better shown when referring to FIGS. 19 and 20, the fastener is a pressure bolt, and the casing is provided with a guiding sleeve positioned within the casing for guiding said pressure bolt. Preferably also, the casing is provided with a spring positioned within the casing and operatively extending between the head of the pressure bolt and the guiding sleeve for exerting a biasing force thereinbetween. Preferably also, and as illustrated, the spring has first and second extremities, the first extremity of the spring being in abutment with a washer mounted about the pressure bolt, adjacent to the head thereof, and a second extremity in abutment with a recess defined within the guiding sleeve.

As better shown in FIGS. 11-14, each securing member may be integrated into a corresponding complementary member, which is preferably a floor panel, as better exemplified in FIG. 1.

It is worth mentioning also that according to the preferred embodiment of the present invention, each of the above-discussed slots is positioned adjacent to a corresponding bulge, so that a corresponding complementary member (e.g. a floor panel) connected to a corresponding bulge of a supporting member, for example, may be secured onto said supporting member by means of a securing member cooperating with said slot adjacent to said corresponding bulge, as can also be easily understood when referring to FIG. 1. According to another preferred embodiment of the present invention, the load-bearing support structure assembled with the present system is a mountable and demountable load-bearing support structure.

Referring back again to FIGS. 11-20, there is shown a preferred embodiment of the securing member (push, turn and lock (PTL) mechanism) according to the present invention. As previously mentioned, the PTL mechanism preferably comprises male and female components.

The male component of the PTL mechanism is preferably a barrel intended to be embedded in a floor panel corner or in all types of structural components and accessories requiring anchorage. Inside the barrel of the PTL, there is preferably a pressure bolt equipped with a washer that, when compressed, activates the spring that ejects a locking tee, as can be easily understood when referring to FIGS. 16-20. The thus manipulated tee lodges itself in the female component, better illustrated in FIGS. 11-15.

The female component of the mechanism has preferably corresponding slots and bulges, as aforementioned. These bulges permit an easier and more precise positioning of the floor or the structural component and accessory requiring anchorage onto the structure.

The anchoring operation is preferably performed by pushing down and turning the pressure bolt (male component) to the right once the floor panel is aligned. A preferred folded metal foled cut out on the female component abuts with the locking tee. Concerning the rotation of the bolt, it allows a suitable fit of the structure and the panel as the bolt secures the panel in place by compression, as can be also easily understood when referring to FIGS. 1 and 11-20, and when referring to the preceeding and following explanation of preferred embodiments (components and features) of the securing member (PTL mechanism).

Indeed, referring specifically to the pressure bolt of the male component of the PTL: firstly, by pushing and turning this bolt, it induces the rotation of the locking cross tee. Once it has reached its final position, the rotation of the bolt secures the floor panel to the truss.

Referring now to the pressure washer of the male component of the PTL: this washer limits the compression of the release spring and the stroke of the bolt head.

Referring now to the release spring of the male component of the PTL: this spring allows the bolt head to reach its neutral position and also serves as an indicator of when the locking cross tee has parted the female component of the PTL (anchoring point).

Referring now to the casing of the male component of the PTL: this part of mechanism is intended namely to protect the interior components from dirt which could alter their operation. It can be inserted in any powering structure or sub-assembly, as apparent to a person skilled in the art.

Referring now to the guiding sleeve of the male component of the PTL: this component aligns the bolt and spring stroke and also acts as a shoulder for the pressure washer. In that case, it is preferably made of threaded steel but it could be made of plastic or any other suitable material with the appropriate retaining device, as also apparent to a person skilled in the art.

Referring now to the locking cross tee of the male component of the PTL: this piece preferably acts as the link between the female part and the male part of the PTL mechanism. Preferably, its half-cylinder shape permits, when dismantling the floor structure, a fast return to its position as it preferably has no sharp edges interacting with the other components.

Referring now to the positioning of the folded cut outs of the male component of the PTL: these cut outs preferably restrain the returning position of the locking cross tee so it is preferably always aligned with the opening in the female part of the PTL.

Referring now to FIGS. 11-15, there is shown different views of the female component of the PTL system. As illustrated, the female component of the PTL system preferably comprises a laser cut steel plate, guiding bulges, openings, and an abutment.

Referring to the laser cut steel plate of the female component of the PTL: this plate preferably serves as a support for the guiding bulges and as thrusts necessary to the action of the PTL male component. The small slits in the metal plate as represented in the accompanying drawings ensure, in that design, a suitable embedment of the plate to its support and, as in all the other structure presented, it allows for plug welds, as apparent to a person skilled in the art. The preferred letter "F" appearing on the plate is intended to only act as a orientation reference mark.

It is worth mentioning that several modifications could be made to the above-described component, without departing from the scope of the present invention. Indeed, the material used to fabricate the plate can be made of any other suitable structural material that offers sturdiness and load-bearing capabilities. Furthermore, the thickness of the plate can be adapted to the load requirements (i.e. "uplift"), as apparent to a person skilled in the art. Moreover, the under structure onto which the plate is anchored can also be made of wood, concrete and/or other, as long as it allows the clearance for the movement of the mechanism, as can also be easily understood by a person skilled in the art. Furthermore, the PTL female connector can be placed on horizontal, vertical and/or at-an-angle structures (the same applies for other components of the present system, as aforementioned and as apparent to a person skilled in the art). This type of anchoring could serve for paneling walls and ceilings. It is to be understood also that the number of anchoring points on the plate can vary from one to any amount considered necessary depending on the particular applications for which it is intended, as apparent to a person skilled in the art.

Referring now to the guiding bulges of the female components of the PTL system: these bulges preferably oblige the floor structure to be placed at the right position so that the male component of the PTL can be easily operated when anchoring the floor panels (or any other paneling). The structure that supports the PTL male component, the corner of the floor panel, for example, is preferably designed with a receptacle for the guiding pins. According to the present invention, all these precautions ensure that no abuse can be put on the mechanism.

Referring now to the slots of the female component of the PTL system: these slots preferably allow part of the PTL male component (i.e. locking cross tee) to penetrate the PTL female connector in the anchoring of the floor panel to its support (such as, for example, a truss, a floor, a wall and/or any other suitable structural component).

Referring now to the thrust of the female component of the PTL system: each slot in the PTL female connector has preferably two thrusts or folded cut outs, as aforementioned, that limit the rotation of the locking cross tee (male part of the PTL) to about 90 degrees. It is worth mentioning however that according to the present invention, other ranges of motions can be included.

Furthermore, it is also worth mentioning that according to the present invention, the geometry of the PTL female component could differ greatly depending on the use of the PTL system. The emphasis should be put on the interaction between the male and female parts of the PTL system as shown in the accompanying drawings. Indeed, the underside view, as better illustrated in FIG. 15, shows where the male and female components meet.

Furthermore, it is worth mentioning also that, according to the present invention, the PTL female connectors can be located at any suitable location within the system depending on the dimensions of the floor panels installed on top, as apparent to a person skilled in the art.

Preferably also, the different components of the system, including the OST, QBC and PTL thereof, are preferably made of a suitable metallic material, such as steel for example, so as to sustain the entire weight of the structure and possible static and/or dynamic loads placed thereon. Preferably also, other suitable material, such as polymeric materials and/or composite materials, and the like, as apparent to a person skilled in the art, could be used so as to properly sustain the weight of the entire structure and the loads it may be subjected to. Indeed, it is worth mentioning though that the system and the different components thereof, according to the present invention, may be made of other suitable materials depending on the applications for which the resulting structure is intended for, as apparent to a person skilled in the art.

As may now be appreciated, the present invention is a substantial improvement over the prior art in that, by virtue of its design and components, the system enables to easily, quickly and securely mount different load-bearing supporting structures, such as stages used in the entertainment world and/or for special events, and the like.

Indeed, the system according to the present invention and the various key components thereof, such as the "push, turn and lock" (PTL) locking/securing mechanism, the open shell truss (OST), and the quad bowtie connector (QBC), provide the present system with several advantages.

For example, the PTL locking mechanism, by virtue of its design and components, as explained hereinabove, enable the following: a) improved or "perfect" bonding of the floor panels and the structure that allows the equal distribution of the loads via a diaphragm effect; b) once locked in place, the floor panel or other accessory are prevented from vibrating or moving; c) it allows not only for the anchoring but also the compression of the panel onto the structure; d) universal mechanism with mechanical properties that are adaptable to the required use (load-bearing structure, decor, turntable, decorative facing, etc.); e) set up and dismantling done from the top of the element to be anchored; f) invisible mechanism since it is fully integrated into the element to be anchored; g)

preferred capacity of about 1500 lbs. per mechanism in upward motion; and h) high capacity mechanism that has a reduced possibility of suffering damage since its components are fully integrated to the structures. Moreover, the PTL locking system is also advantageous in that it is preferably fabricated so that the machining of the mechanism parts allows a very precise fit.

Furthermore, as may now be better appreciated, the open shell truss according to the present invention is also advantageous in that, it is preferably a four-faced open truss design, and one or all of the faces can be designed with the PTL female component along its length to adapt to the required use, as apparent to a person skilled in the art. Furthermore, the truss has a double anchoring plate at its ends, which is also advantageous. Other advantages of this component are the following: a) the flat surfaces allow a stable and safe support to any structure or accessory; b) the positioning of the truss is universal in relation to the desired configuration; c) the dimensions of the truss can be adapted to any required load-bearing capacity or usage; d) this truss can be fabricated with any material offering structural properties; e) it can be provided with any temporary or permanent anchoring system for rigging or for adding scenic elements; f) it can be set up in the vertical, horizontal or at angled positions; g) the truss is relatively light, ideally sized for transportation and resistant to handling and impact; h) once fully assembled, the load-bearing capacity is optimized to support both static and dynamic loads; i) the preferred square box truss design combined with its connection to the upright supports at both ends allows for lateral stability not requiring bracing legs; j) because of its universality, this truss facilitates the addition of scenic elements at any point along its length since their anchoring points can be easily integrated to the truss; k) the removal of some floor panels permitting the integration of the scenic elements does not compromise the load-bearing properties of the truss; l) there is no longer a need to overlap multiple floor panels; m) it allows unlimited performance base and layout of the stage; n) it allows for multiple levels of stages while maintaining the conviviality of the structural component anchorage between them; o) there is minimal hardware needed for assembly and the hardware can be modified relative to the structural loads required of the structure; p) optimization of the space beneath the stage which allows for storage, technical booths or passageways; q) the system allows a set up time of about three (3) times faster than any other type of temporary structure for an equivalent load-bearing capacity; and r) it does not require specialized manpower.

The open shell truss according to the present invention is also advantageous from a fabrication and design point of view in that the assembly of laser-cut lightweight steel plates requires about half the time than other types of structures for an equal or greater load-bearing capacity; and the open design allows the truss to be galvanized, zinc-plated, or painted without leaving any residue, and the like.

The quad bowtie connector according to the present invention is also advantageous in that it is a strirrup compatible with the OST offering up to a preferred four anchoring points, and the QBC is preferably maintained in place by any standard support, such as screw jacks, legs, anchor plates, and the like, as apparent to a person skilled in the art. Moreover, the quad bowtie connector offers the following advantages: it is used on any one or many connecting positions, and offers the support and stability required to meet the load-bearing capacity; the QBC's position is universal in the required layout; and the QBC may include the female component of the PTL, if required.

Of course, numerous modifications could be made to the above-described embodiments without departing from the scope of the present invention, as defined in the appended claims.

The invention claimed is:

1. A system for assembling a load-bearing support structure, the system comprising:

at least one supporting member, said at least one supporting member comprising an upper surface, and opposite first and second end surfaces, the upper surface being provided with at least one section comprising at least one bulge protruding from said upper surface;

at least one connecting member for connecting said at least one supporting member to at least one other member; and at least one complementary member for affixing onto at least one of said at least one supporting member, said at least one complementary member comprising at least one orifice being positioned, shaped and sized for inserting into the at least one bulge of a corresponding supporting member so as to form the load-bearing support structure;

wherein each end surface of each supporting member comprises a pair of upper and lower connecting flanges, said pair of upper and lower connecting flanges being connectable to a corresponding pair of upper and lower connecting flanges of the least one connecting member.

2. A system according to claim 1, wherein the at least one bulge comprises at least two bulges, each bulge being used for receiving a corresponding complementary member of the system.

3. A system according to claim 1, wherein the at the at least one bulge comprises at least four bulges, each bulge being used for receiving a corresponding complementary member of the system, and the four bulges being positioned about the upper surface of the at least one supporting member so as to form a rectangular configuration.

4. A system according to claim 1, wherein the at least one section comprises first and second sections being positioned respectively on opposite end sections of the upper surface of the at least one supporting member.

5. A system according to claim 4, wherein the upper surface of the at least one supporting member is provided with a third section comprising at least one bulge, said third section being positioned between the first and section sections, and substantially at a midpoint section of the upper surface of the at least one supporting member.

6. A system according to claim 1, wherein each supporting member is an open shell truss.

7. A system according to claim 1, wherein the at least one supporting member comprises a channel defined within said at least one supporting member and extending from a lower surface to an upper surface thereof.

8. A system according to claim 1, wherein an upper surface of the at least one connecting member is provided with a plate comprising at least one bulge protruding from said upper surface for receiving a corresponding orifice of a corresponding complementary member of the system.

9. A load-bearing support structure assembled with a system according to claim 1, the load-bearing structure comprising:

at least one supporting member, said at least one supporting member comprising an upper surface, and opposite first and second end surfaces, the upper surface being provided with at least one section comprising at least one bulge protruding from said upper surface;

at least one connecting member connecting said at least one supporting member to at least one other member; and at least one complementary member affixed onto at least one of said at least one supporting member, said at least one complementary member comprising at least one orifice inserted into the at least one bulge of a corresponding supporting member so as to form the load-bearing support structure;

wherein each end surface of each supporting member comprises a pair of upper and lower connecting flanges, said pair of upper and lower connecting flanges being connected to a corresponding pair of upper and lower connecting flanges of the least one connecting member.

10. A system for assembling a load-bearing support structure, the system comprising:

at least one supporting member, said at least one supporting member comprising an upper surface, and opposite first and second end surfaces, the upper surface being provided with at least one section comprising at least one bulge protruding from said upper surface;

at least one connecting member for connecting said at least one supporting member to at least one other member; and at least one complementary member for affixing onto at least one of said at least one supporting member, said at least one complementary member comprising at least one orifice being positioned, shaped and sized for inserting into the at least one bulge of a corresponding supporting member so as to form the load-bearing support structure;

wherein the at least one connecting member has opposite first and second end surfaces, and opposite front and rear end surfaces, the first and second surfaces of the at least one connecting member being each provided with a least one connecting flange, each connecting flange being connectable with a corresponding connecting flange of the at least one supporting member; and wherein the at least one connecting flange comprises a pair of upper and lower connecting flanges, said pair of upper and lower connecting flanges being connectable to a corresponding pair of upper and lower connecting flanges of the least one supporting member.

11. A system according to claim 10, wherein the front and rear surfaces of the at least one connecting member are each provided with a least one connecting flange, each connecting flange being connectable with a corresponding connecting flange of at least one other member of the system.

12. A system according to claim 11, wherein the at least one connecting flange comprising a pair of upper and lower connecting flanges, said pair of upper and lower connecting flanges being connectable to a corresponding pair of upper and lower connecting flanges of the least one other member of the system.

13. A load-bearing support structure assembled with a system according to claim 10, the load-bearing structure comprising:

at least one supporting member, said at least one supporting member comprising an upper surface, and opposite first and second end surfaces, the upper surface being provided with at least one section comprising at least one bulge protruding from said upper surface;

at least one connecting member connecting said at least one supporting member to at least one other member; and at least one complementary member affixed onto at least one of said at least one supporting member, said at least one complementary member comprising at least one orifice inserted into the at least one bulge of a corresponding supporting member so as to form the load-bearing support structure;

wherein the at least one connecting member has opposite first and second end surfaces, and opposite front and rear end surfaces, the first and second surfaces of the at least one connecting member being each provided with a least one connecting flange, each connecting flange being connected with a corresponding connecting flange of the at least one supporting member; and wherein the at least one connecting flange comprises a pair of upper and lower connecting flanges, said pair of upper and lower connecting flanges being connected to a corresponding pair of upper and lower connecting flanges of the least one supporting member.

14. A system for assembling a load-bearing support structure, the system comprising:

at least one supporting member, said at least one supporting member comprising an upper surface, and opposite first and second end surfaces, the upper surface being provided with at least one section comprising at least one bulge protruding from said upper surface, the at least one supporting member also comprising at least one slot;

at least one connecting member for connecting said at least one supporting member to at least one other member; and at least one complementary member for affixing onto at least one of said at least one supporting member, said at least one complementary member comprising at least one orifice being positioned, shaped and sized for inserting into the at least one bulge of a corresponding supporting member so as to form the load-bearing support structure;

wherein the system further comprises at least one securing member cooperable between the at least one complementary member and the at least one supporting member for securing said at least one complementary member onto said at least one supporting member, the at least one securing member comprising:

a casing having opposite upper and lower ends; and a fastener extending within the casing and being displaceable thereabout, the fastener being insertable through a corresponding slot of the at least one supporting member, said fastener having a first extremity provided with a head and an opposite second extremity extendable beyond the lower end of the casing for receiving a locking tee positionable via the fastener beyond the corresponding slot of the at least one supporting member, the locking tee being cooperable with said fastener and said corresponding slot so that a rotation of the fastener via its head operatively urges the locking tee towards the head of the fastener and in abutment with an underside portion of the corresponding slot, so as to operatively clamp the at least one supporting member between the casing and the locking tee of the at least one securing member.

15. A system according to claim 14, wherein the fastener is a pressure bolt, and wherein the casing is provided with a guiding sleeve positioned within the casing for guiding said pressure bolt, the casing being further provided with a spring positioned within the casing and operatively extending between the head of the pressure bolt and the guiding sleeve for exerting a biasing force thereinbetween.

16. A system according to claim 14, wherein the at least one securing member is integrated into the at least one complementary member.

17. A system according to claim 14, wherein each slot is positioned adjacent to a corresponding bulge of the system.

18. A load-bearing support structure assembled with a system according to claim 14, the load-bearing structure comprising:

at least one supporting member, said at least one supporting member comprising an upper surface, and opposite first and second end surfaces, the upper surface being provided with at least one section comprising at least one bulge protruding from said upper surface, the at least one supporting member also comprising at least one slot;

at least one connecting member connecting said at least one supporting member to at least one other member; and at least one complementary member affixed onto at least one of said at least one supporting member, said at least one complementary member comprising at least one orifice inserted into the at least one bulge of a corresponding supporting member so as to form the load-bearing support structure;

wherein the system further comprises at least one securing member cooperating between the at least one complementary member and the at least one supporting member for securing said at least one complementary member onto said at least one supporting member, the at least one securing member comprising:

a casing having opposite upper and lower ends; and a fastener extending within the casing and being displaceable thereabout, the fastener being insertable through a corresponding slot of the at least one supporting member, said fastener having a first extremity provided with a head and an opposite second extremity extendable beyond the lower end of the casing for receiving a locking tee positionable via the fastener beyond the corresponding slot of the at least one supporting member, the locking tee being cooperable with said fastener and said corresponding slot so that a rotation of the fastener via its head operatively urges the locking tee towards the head of the fastener and in abutment with an underside portion of the corresponding slot, so as to operatively clamp the at least one supporting member between the casing and the locking tee of the at least one securing member.

* * * * *